US010335926B2

(12) United States Patent
Mack

(10) Patent No.: US 10,335,926 B2
(45) Date of Patent: Jul. 2, 2019

(54) VISE

(71) Applicant: Edward Mack, Bothell, WA (US)

(72) Inventor: Edward Mack, Bothell, WA (US)

(73) Assignee: Concepts To Solutions, LLC, Everett, WA (US)

( * ) Notice: Subject to any disclaimer, the term of this patent is extended or adjusted under 35 U.S.C. 154(b) by 0 days.

(21) Appl. No.: 16/014,653

(22) Filed: Jun. 21, 2018

(65) Prior Publication Data

US 2018/0297175 A1 Oct. 18, 2018

Related U.S. Application Data

(63) Continuation-in-part of application No. 16/011,891, filed on Jun. 19, 2018.

(60) Provisional application No. 62/523,088, filed on Jun. 21, 2017.

(51) Int. Cl.

| | |
|---|---|
| ***B25B 5/00*** | (2006.01) |
| ***B25B 1/24*** | (2006.01) |
| ***B25B 1/02*** | (2006.01) |
| ***B25B 1/10*** | (2006.01) |

(52) U.S. Cl.

CPC ..... *B25B 1/2484* (2013.01); *B25B 1/02* (2013.01); *B25B 1/103* (2013.01); *B25B 1/241* (2013.01)

(58) Field of Classification Search

CPC .... B25B 1/00; B25B 1/10; B25B 1/08; B25B 5/08; B25B 5/087

See application file for complete search history.

(56) References Cited

U.S. PATENT DOCUMENTS

| | | | | |
|---|---|---|---|---|
| 4,299,377 | A * | 11/1981 | Lenz | B25B 1/106 269/136 |
| 4,395,030 | A * | 7/1983 | Eskuchen | B25B 1/125 269/181 |
| 4,438,911 | A * | 3/1984 | McDougal | B25B 1/18 269/157 |
| 6,202,997 | B1 * | 3/2001 | Yasuda | B25B 1/103 269/195 |
| 2002/0096813 | A1 * | 7/2002 | Weaver | B25B 1/2463 269/282 |
| 2018/0297175 | A1 * | 10/2018 | Mack | B25B 1/2484 |

* cited by examiner

*Primary Examiner* — Lee D Wilson
(74) *Attorney, Agent, or Firm* — Puget Patent; Michael Gibbons

(57) ABSTRACT

A vise includes a base plate that receives a fixed jaw and a pusher jaw. The fixed jaw receiving portion of the base plate includes particular stations for receiving the fixed jaw, the particular stations defined by at least a latitudinal slot at each particular station, each latitudinal slot configured for receiving a latitudinal tab extending from the bottom of the fixed jaw. A longitudinal slot traversing a length of the fixed jaw receiving portion of the base plate may receive a longitudinal tab extending from the bottom of the fixed jaw. Double-threaded lock bolts secure the fixed jaw to the base plate once the tabs are engaged with the slots of the base plate. The pusher jaw portion of the base plate includes a worm shaft, a threaded portion of the worm shaft engaging a worm shaft mating portion milled from the bottom of the pusher jaw. The pusher jaw portion of the base plate also includes a slide bar cavity arrangement into which slide bars at the bottom of the pusher jaw slide previous to engagement of the worm shaft with the worm shaft mating portion of the pusher jaw.

20 Claims, 11 Drawing Sheets

VISE

PRIORITY CLAIM

The present application is related to and/or claims the benefits of the earliest effective priority date and/or the earliest effective filing date of the below-referenced applications, each of which is hereby incorporated by reference in its entirety, to the extent such subject matter is not inconsistent herewith, as if fully set forth herein:

(1) this application constitutes a non-provisional of U.S. Provisional Patent Application No. 62/523,088, entitled WORK PIECE POSITIONING ASSEMBLY AND HEM-BACK VISE, naming Edward Mack as the inventor, filed Jun. 21, 2017, which is an application of which a currently co-pending application is entitled to the benefit of the filing date; and (2) this application constitutes a continuation-in-part of U.S. patent application Ser. No. 16/011,891, entitled VISE STOP ARRANGEMENT, naming Edward Mack is the inventor, filed Jun. 19, 2018, which is currently co-pending or is an application of which a currently co-pending application is entitled to the benefit of the filing date.

FIELD OF THE INVENTION

This invention relates generally to work holders, and, more specifically, to a vise.

BACKGROUND OF THE INVENTION

Machinist jigs and fixturing may include vises and associated parts for positioning and subsequently milling workpieces. For example, a vise is typically used when milling a part on a milling machine, such as a Bridgeport milling machine or its equivalent. Such a vise typically has a flat bottom base plate that mounts against the bed of the milling machine. On the top are jaws that hold a workpiece so that a cutter head can shape the workpiece without its moving about. Vise jaws may typically be of a fixed or removable type to accommodate varying workpiece shapes. In shaping a workpiece the cutter head typically moves about a fixed workpiece. In alternative examples a workpiece held in a vise may move about with the cutter head being held in a fixed position.

In either configuration a problem often encountered is the quick changeability of vise jaws and a desire for the vise. Additionally it is desirable for the jaws of the vise not to interfere with the path of the cutter head as it shapes the workpiece. This typically involves moving and repositioning the workpiece for each pass of the cutter heads, as the workpiece is shaped. To maintain the dimensional accuracy of a part produced from a workpiece it is important to maintain dimensions when the part is repositioned, and to provide a set up that can be quickly changed so that accurate parts may be produced in quick fashion. Accordingly providing devices that aid in the set up and rapid production of parts with repeatable and accurate dimensions from workpieces tend to be desirable.

SUMMARY

The disclosed invention provides a vise which includes a base plate with longitudinal and latitudinal slots which receive tabs on the underside of a fixed jaw, the base plate also including a worm shaft arrangement configured for driving a pusher jaw into which threads are milled on its underside that mate with a worm shaft coupled to the base plate.

The foregoing is a summary and thus contains, by necessity, simplifications, generalizations and omissions of detail; consequently, those skilled in the art will appreciate that the summary is illustrative only and is not intended to be in any way limiting. Other aspects, embodiments, features and advantages of the device and/or processes and/or other subject matter described herein will become apparent in the teachings set forth herein.

BRIEF DESCRIPTION OF THE DRAWINGS

Certain embodiments of the present invention are described in detail below with reference to the following drawings.

DETAILED DESCRIPTION

Specific details of certain embodiments of the invention are set forth in the following description and in the figures to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

Figure 1A:
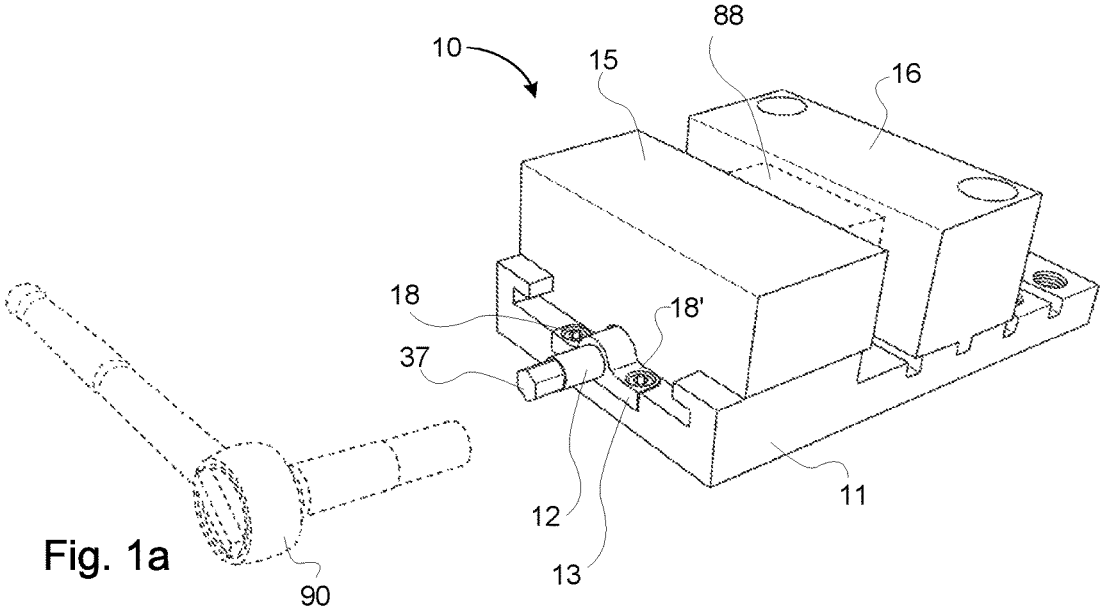
FIGS. 1*a*, 1*b*, and 1*c* are a top perspective view, a top view, and a right side view of a vise.
Figure 1B:
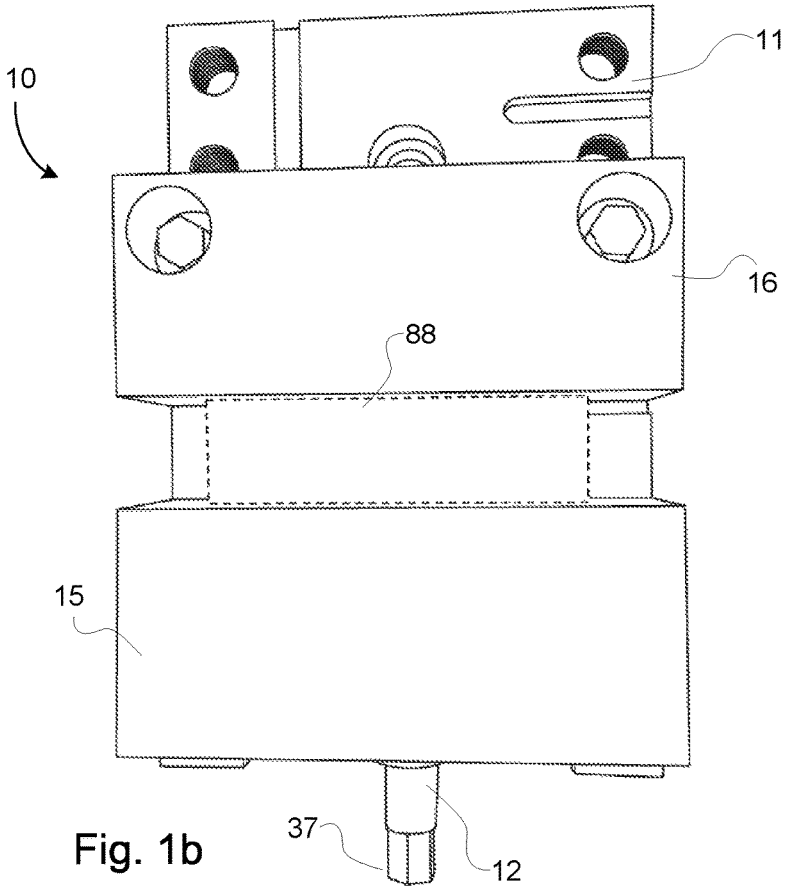
Figure 1C:
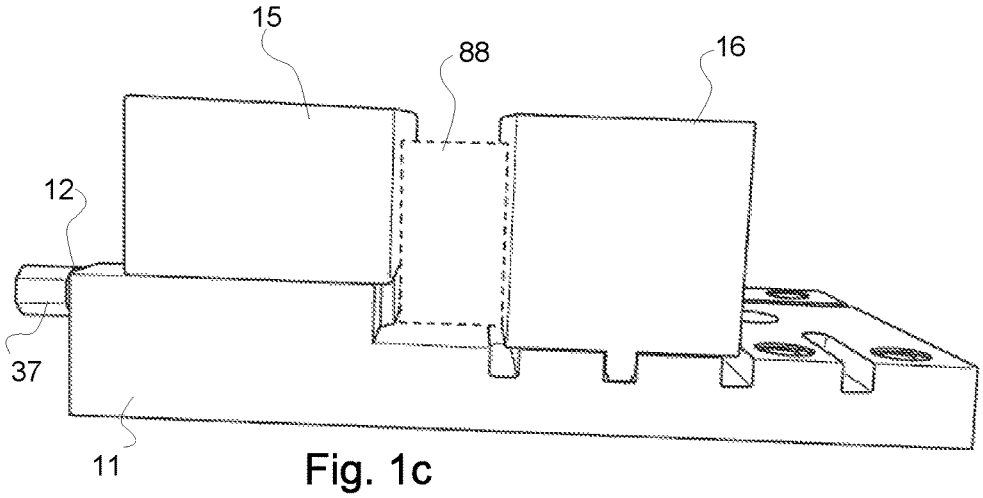

FIGS. 1*a*, 1*b*, and 1*c* are a top perspective view, a top view, and a right side view of a vise. The vise 10 is used to hold workpiece 88 between pusher jaw 15 and fixed jaw 16, which are coupled with base plate 11. (The workpiece is depicted in dashed lines to convey that the workpiece is not an actual part of the invention.) The fixed jaw is securably mounted to the base plate at a particular station of the base plate by means which will be discussed below with respect to FIGS. 5*a* and 5*b*. The pusher jaw is slidably engaged with the base plate by means which will be discussed below with respect to FIGS. 6*a* and 6*b*. The longitudinal depth of the pusher jaw (i.e. the location of the pusher jaw from front to back of the vise) is controlled through operation of the worm shaft 12, which is held in place by front keeper 13 and a rear keeper (the rear keeper not viewable in FIGS. 1*a*-1*c* but depicted and explained in FIGS. 3*c* and 3*d*), the front keeper coupled to the base plate using fasteners 18 and 18'. The worm shaft may have a hexagonal portion 37 at its front so that it may be operated with a hand tool 90 (the hand tool being depicted in dashed lines to convey that the hand tool is not an actual part of the invention).

FIGS. 2*a*, 2*b*, 2*c*, 2*d*, and 2*e* are a top view, a front view, a rear view, a right side view, and a bottom view of a base plate of the vise. The base plate may mount to a milling machine, a pallet or other fixture in various ways. One mounting arrangement for the base plate includes the use of one or more counterbore holes 26, 26', 26", and 26'" drilled through the base plate, the wide portion of the counterbore hole facing up (i.e. disposed through the top of the base plate) and the narrow portion of the counterbore hole facing down (i.e. disposed through the bottom of the base plate). The base plate may also include table key mount holes 36 and 36' in the underside of the base plate for facilitating mounting of the base plate to a milling machine or fixture.

Figure 2A:
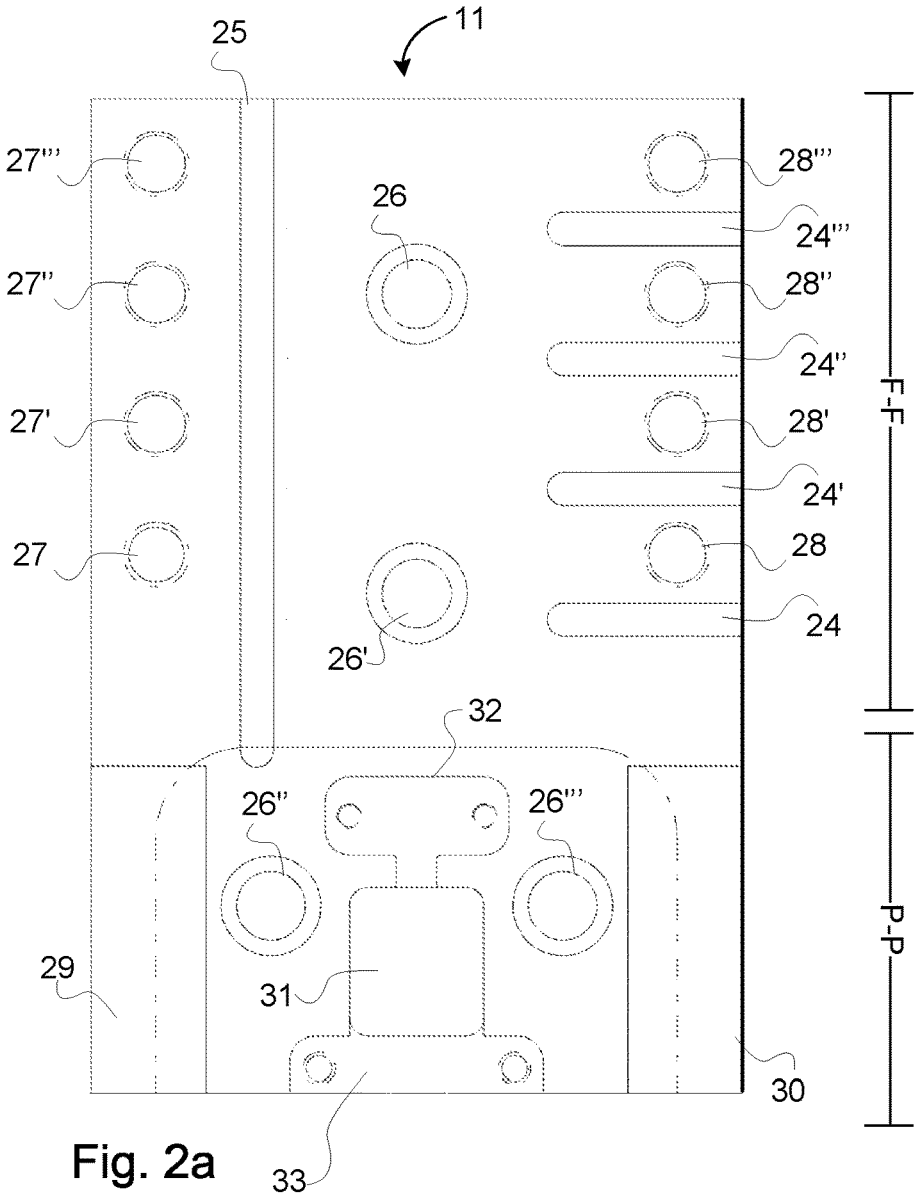
FIGS. 2*a*, 2*b*, 2*c*, 2*d*, and 2*e* are a top view, a front view, a rear view, a right side view, and a bottom view of a base plate of the vise.
Figure 2B:
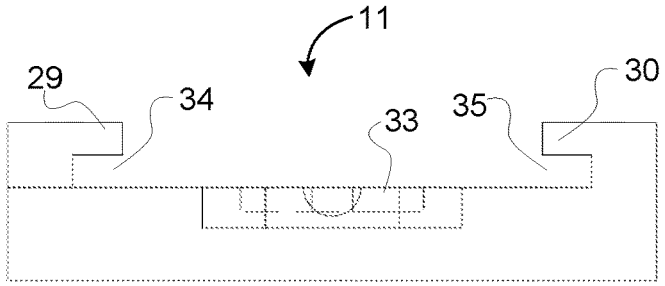
Figure 2C:
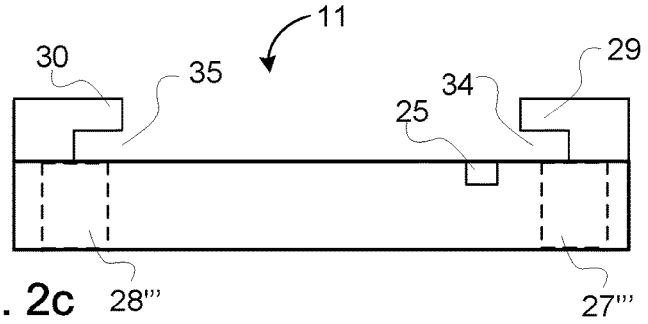
Figure 2D:
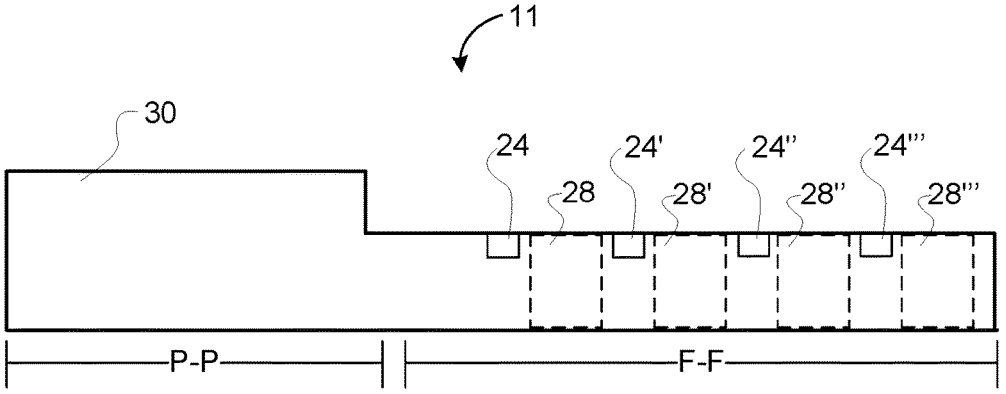
Figure 2E:
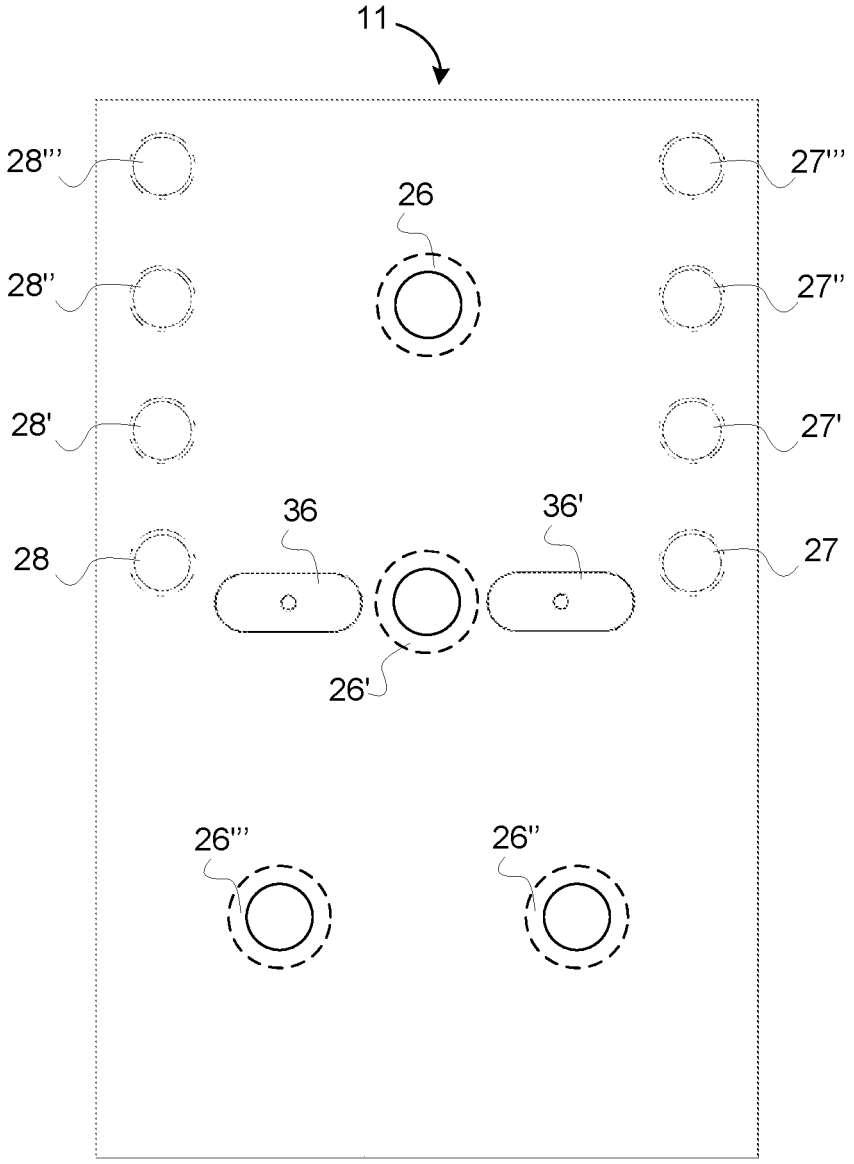

The fixed jaw mounts at particular stations within the fixed jaw receiving portion of the base plate, the fixed jaw receiving portion being depicted in FIGS. 2*a* and 2*d* along the line F-F. The pusher jaw slides into place from the front of the base plate and rests within the pusher jaw receiving portion of the base plate, the pusher jaw receiving portion being depicted in FIGS. 2*a* and 2*d* along the line P-P.

The fixed jaw receiving portion of the base plate includes a fixed jaw slot arrangement, which is shown in FIG. 2*a* as including a longitudinal fixed jaw slot 25 and four latitudinal fixed jaw slots 24, 24', 24", and 24'". It will be seen with reference to FIGS. 4*a*-4*e* that the fixed jaw includes a longitudinal tab disposed on the bottom of the fixed jaw for interfacing with the longitudinal fixed jaw slot in the base plate, and includes a latitudinal tab also disposed on the bottom of the fixed jaw for interfacing with one of the four latitudinal fixed jaw slots in the base plate.

Selecting a particular latitudinal fixed jaw slot of the base plate for coupling with the latitudinal tab on the bottom of the fixed jaw will determine one of four stations for the fixed jaw from front to back of the vise. Once the fixed jaw is rested on top of the base plate at the particular station (i.e. with the latitudinal tab of the fixed jaw inserted into one of the latitudinal fixed jaw slots of the base plate and with the longitudinal tab of the fixed jaw inserted into the longitudinal fixed jaw slot of the base plate), the fixed jaw may be securably mounted to the base plate by passing threaded fasteners through counterbore holes disposed within the fixed jaw and into fixed threaded mount holes of the base plate, including a left threaded mount hole 27 and a right threaded mount hole 28. The threaded mount holes are located along the base plate so as to align with the counterbore holes in the fixed jaw. In the embodiment depicted herein, to utilize the second position from the rear for the fixed jaw, the latitudinal tab of the fixed jaw would engage the latitudinal fixed jaw slot 24" and the two counterbore holes disposed within the fixed jaw would align with left threaded mount hole 27" and right threaded mount hole 27" of the base plate.

The pusher jaw receiving portion of the base plate includes two overhangs, a left overhang 29 and right overhang 30, which create a left slide bar cavity 34 and a right slide bar cavity 35. The slide bar cavities are sized to receive slide bars of the pusher jaw, enabling the slide bars of the pusher jaw to be slid into position underneath the overhangs and pushed towards the back until the fixed jaw comes to rest against the threaded portion of the worm screw. The pusher jaw receiving portion of the base plate also includes cavities which, from front to back, include front keeper cavity 33, worm shaft cavity 31, and rear keeper cavity 32. The front keeper cavity and rear keeper cavity include mount holes for receiving threaded fasteners that have been passed through counterbore holes in a front keeper and rear keeper (as discussed with respect to FIGS. 3*a*-3*d*).

Figure 3A:
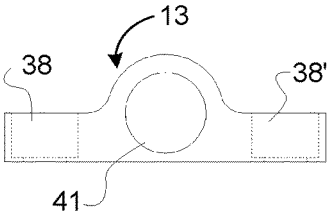
FIG. 3*a* is a front view of a front keeper of the vise.
Figure 3B:
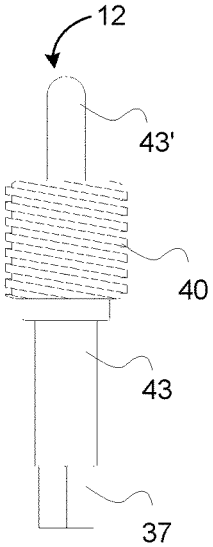
FIG. 3*b* is a side view of a worm shaft of the vise.
Figure 3D:
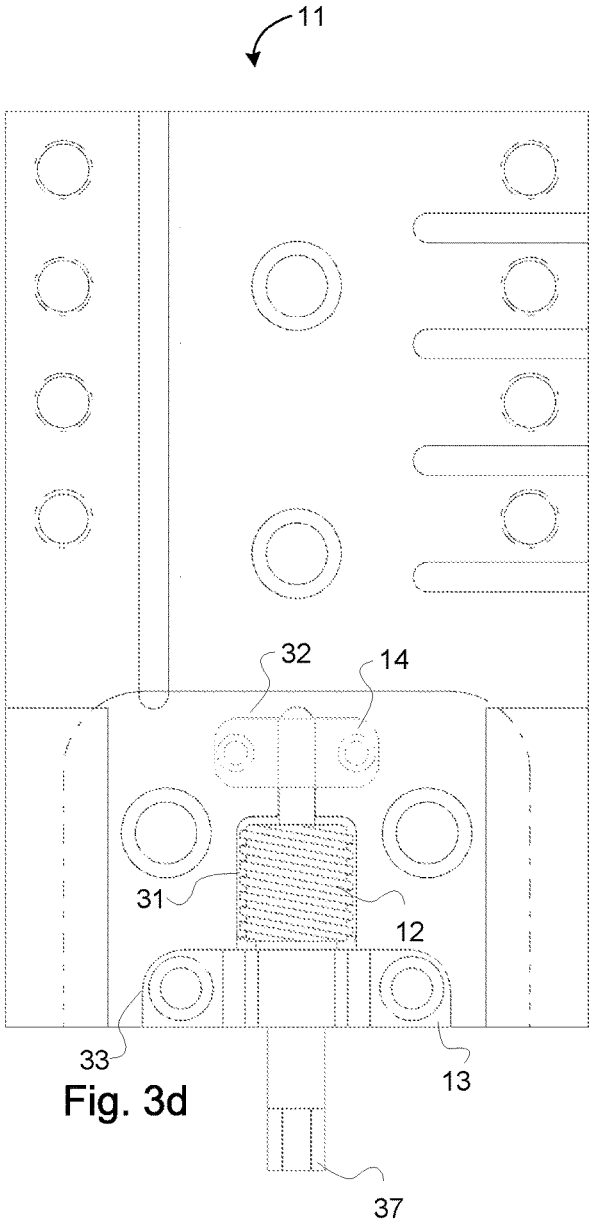
FIG. 3*d* is a top view of the base plate of the vise with the worm shaft, front keeper, and rear keeper in place.
Figure 3C:
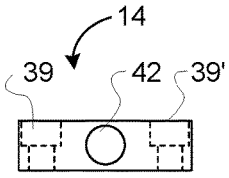
FIG. 3*c* is a front view of a rear keeper of the vise.
Figure 4A:
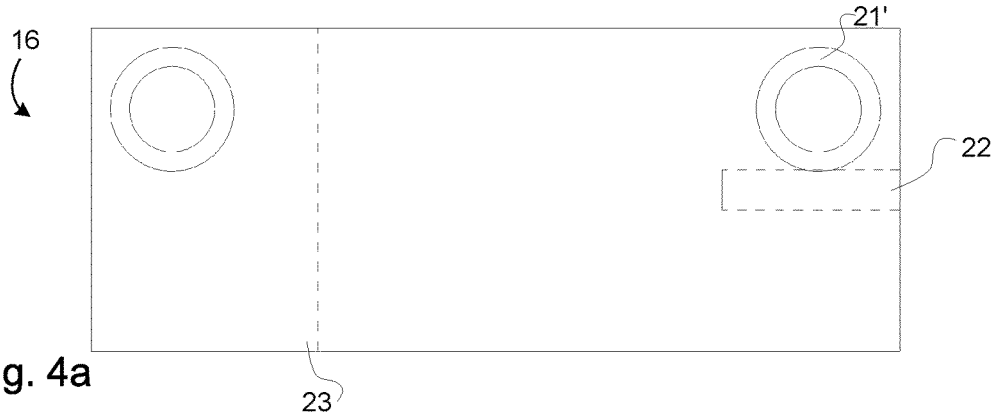
FIGS. 4*a*, 4*b*, 4*c*, 4*d*, and 4*e* are a top view, a front view, a bottom view, a left side view, and a right side view of a fixed jaw of the vise.
Figure 4B:
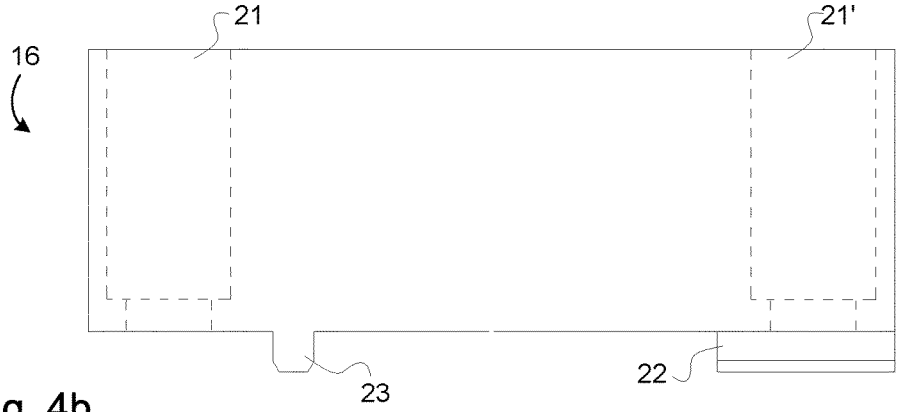
Figure 4C:
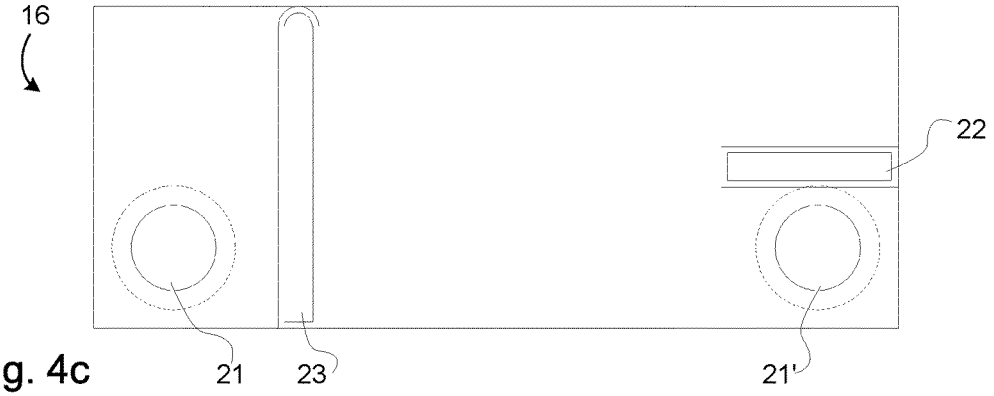
Figure 4D:
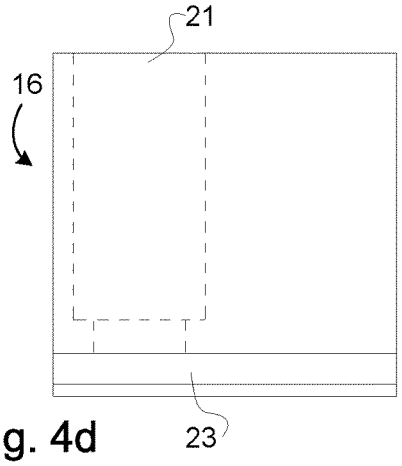
Figure 4E:
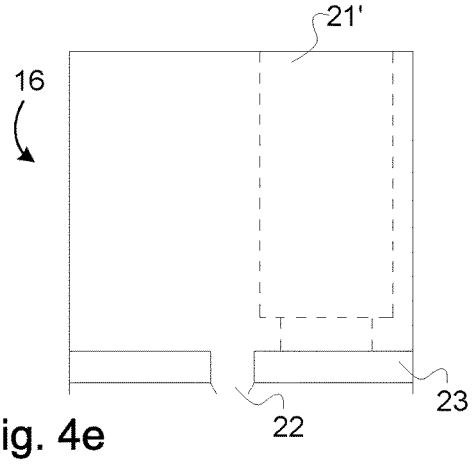

FIG. 3*a* is a front view of a front keeper of the vise. FIG. 3*b* is a side view of a worm shaft of the vise. FIG. 3*c* is a front view of a rear keeper of the vise. FIG. 3*d* is a top view of the base plate of the vise with the worm shaft, front keeper, and rear keeper in place. The worm shaft 12 is locked in a rotatable position between the front keeper 13 and rear keeper 14, the front keeper and rear keeper having a front keeper cylindrical channel 41 and rear keeper cylindrical channel 42 disposed through them permitting cylindrical portions 43 and 43' of the worm shaft to pass through. A threaded portion 40 of the worm shaft is disposed between the worm shaft cylindrical portions. Upon the cylindrical portions of the worm shaft being inserted into the rear keeper and front keeper, the arrangement of the rear keeper, worm shaft, and front keeper may be laid into the rear keeper cavity 32, worm screw cavity 31, and front keeper cavity 33 of base plate 11, with the rear keeper and front keeper secured to the base plate using threaded fasteners (such as front keeper fasteners 18 and 18' visible in FIG. 1*a*) that are passed through rear keeper counterbores 39 and 39' and front keeper counterbores 38 and 38'. The worm screw may then be rotated freely through operation of the hexagonal portion 37 of the worm shaft, which may be engaged by a hand tool such as the hand tool 90 visible in FIG. 1*a*. It will be seen during discussion of FIGS. 6*a* and 6*b* that operation of the worm shaft will move a pusher jaw disposed in the pusher jaw receiving portion of the base plate in a longitudinal direction with respect to the vise (that is, move the pusher jaw towards the back of the vise when the worm shaft is rotated clockwise when the vise is viewed from the front and move the pusher jaw towards the front of the vise when the worm shaft is rotated counter-clockwise when the vise is viewed from the rear).

FIGS. 4*a*, 4*b*, 4*c*, 4*d*, and 4*e* are a top view, a front view, a bottom view, a left side view, and a right side view of a fixed jaw of the vise. A fixed jaw 16 has the same width as the base plate. Two counterbore mount holes 21 and 21' are disposed through the fixed jaw, proximate to the rear of the fixed jaw, the wide portion of the counterbore hole facing up (i.e. disposed through the top of the fixed jaw) and the narrow portion of the counterbore hole facing down (i.e. disposed through the bottom of the fixed jaw). The counterbore mount holes of the fixed jaw are spaced laterally to match the distance between the rows of left threaded mount holes 27 and right threaded mount holes 28 of the base plate shown in FIG. 2*a*. A fixed jaw longitudinal tab 23 extends downward from the bottom of the fixed jaw, proximate to the left side of the fixed jaw and positioned to align with the longitudinal fixed jaw slot of the base plate shown in FIG. 2*a* when the fixed jaw is placed on top of the base plate. A fixed jaw latitudinal tab 22 also extends downward from the bottom of the fixed jaw, proximate to the right side of the fixed jaw and positioned to align with one of the four longitudinal fixed jaw slots of the base plate shown in FIG. 2*a* when the fixed jaw is placed on top of the base plate.

Figure 5A:
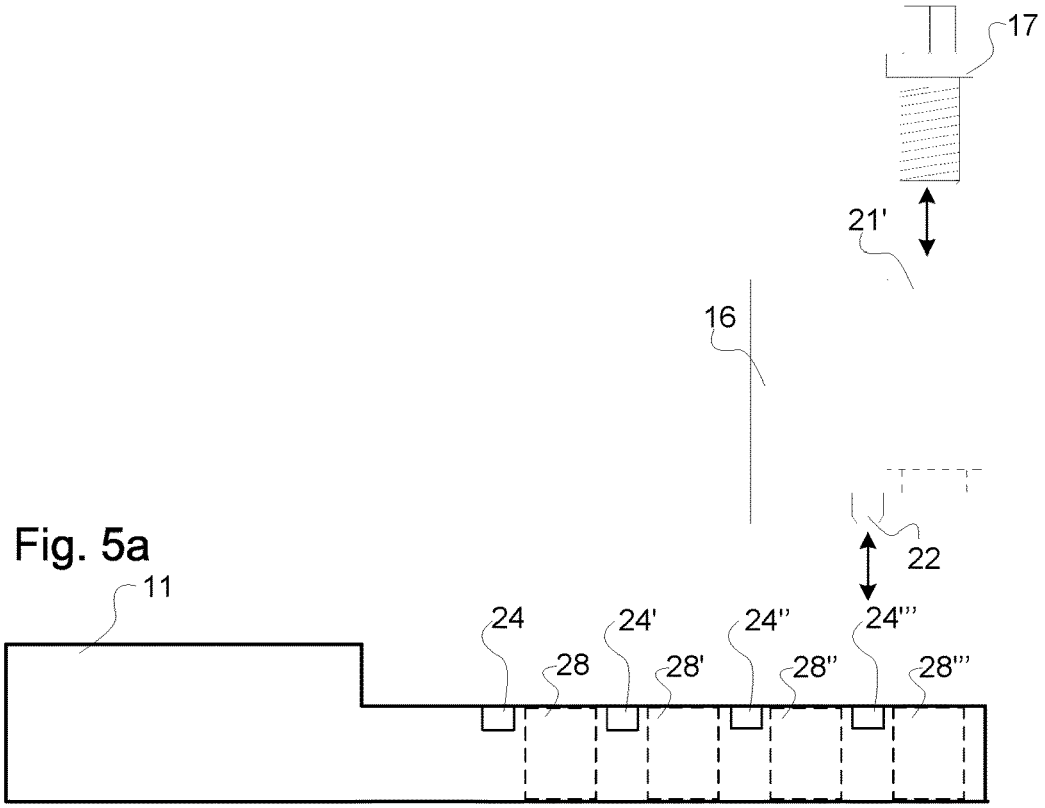
FIGS. 5*a* and 5*b* are a right side exploded view and a rear exploded view depicting assembly the fixed jaw with the base place of the vise.
Figure 5B:
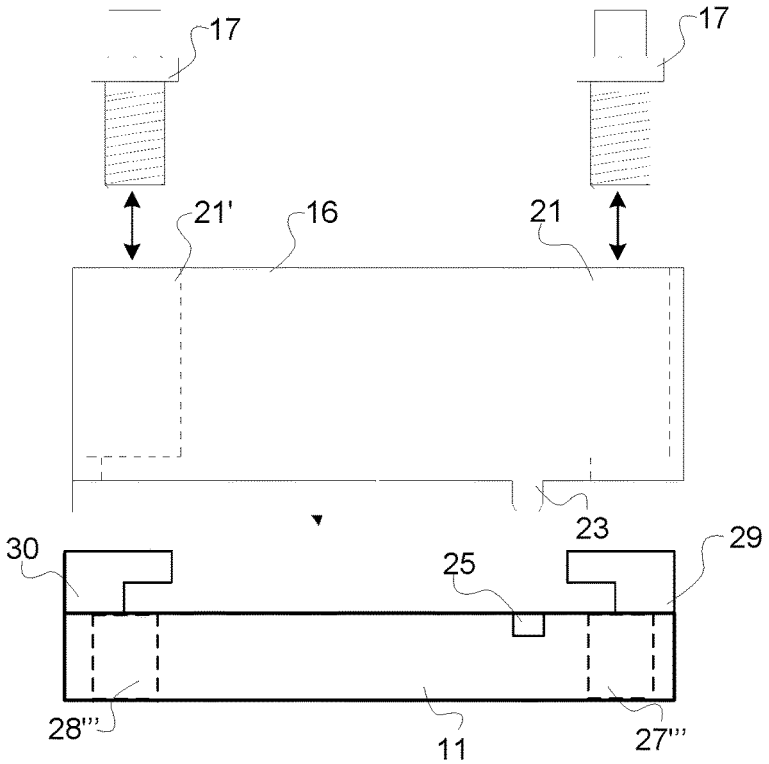

FIGS. 5*a* and 5*b* are a right side exploded view and a rear exploded view depicting assembly the fixed jaw with the base place of the vise. The fixed jaw 16 is affixed to the base plate 11 at one of four stations from front to back of the base plate, in the fixed jaw receiving portion of the base plate (i.e. between the base plate left overhang 29 and right overhang 30 and the rear of the vise). For example, if it is desired to affix the base plate at the rear-most station of the base plate, an operator would position the fixed jaw above the base plate with the latitudinal fixed jaw tab 22 positioned above the latitudinal fixed jaw slot 28''' of the base plate (i.e. the rear-most slot, closest to the back of the vise) and lower the fixed jaw onto the top of the base plate, allowing the longitudinal fixed jaw tab 23 to rest inside the longitudinal fixed jaw slot 25 of the base plate. The operator may then insert a threaded fastener 17 through each of the two fixed jaw counterbore mount channels 21 and 21' and into the threaded mount holes 27''' and 28''' of the base plate before tightening the threaded fasteners. In some embodiments, the threaded fasteners 17 are double-lead threaded bolts, with the threaded mount holes 27 and 28 of the base plate being double-lead threaded as well.

It is noted that the double-lead threaded bolts will hold the fixed jaw in place more securely, with twice the holding torque available, than with standard single-lead threaded bolts, enabling the fixed jaw to more strongly resist pressure brought against it during machining operations on a workpiece held by the vise and partially supported by the fixed jaw.

It is further noted that providing the longitudinal and latitudinal tabs which interface with corresponding longitudinal and latitudinal slots in the base plate key the fixed jaw in both axes, providing additional security against the fixed jaw moving in an undesirable way due to pressure applied to the fixed jaw during milling operations.

Figure 6A:
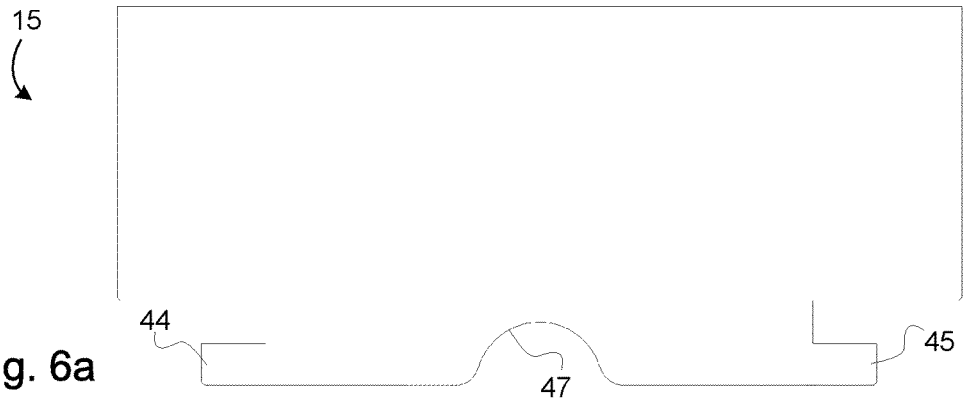
FIGS. 6*a*, 6*b*, and 6*c* are a front view, a bottom view, and a rear view of a pusher jaw.
Figure 6B:
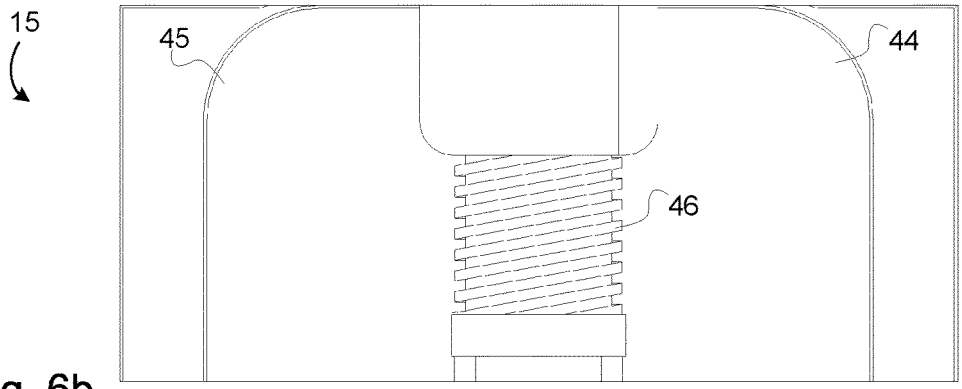
Figure 6C:
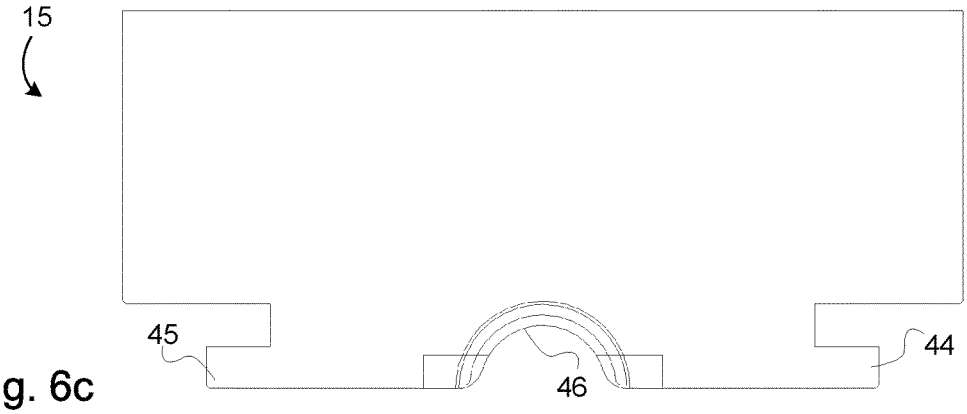

FIGS. 6*a*, 6*b*, and 6*c* are a front view, a bottom view, and a rear view of a pusher jaw. A pusher jaw 15 has a left slide bar 44 and right slide bar 45 proximate to the bottom of the pusher jaw. The left slide bar and right slide bar are sized to fit underneath the left overhang and right overhang of the pusher jaw receiving portion of the base plate, sliding into the left slide bar cavity and right slide bar cavity of the base plate. From the bottom of the pusher jaw is milled a threaded worm shaft mating portion 48, the threads configured to mate with the threaded portion of the worm shaft. Through the front of the pusher jaw is arcuate portion 47 proximate to the bottom of the pusher jaw and between the left and right slide bars, the arcuate portion providing a passageway for the worm shaft to extend to the outside of the vise from its front.

Figure 7A:
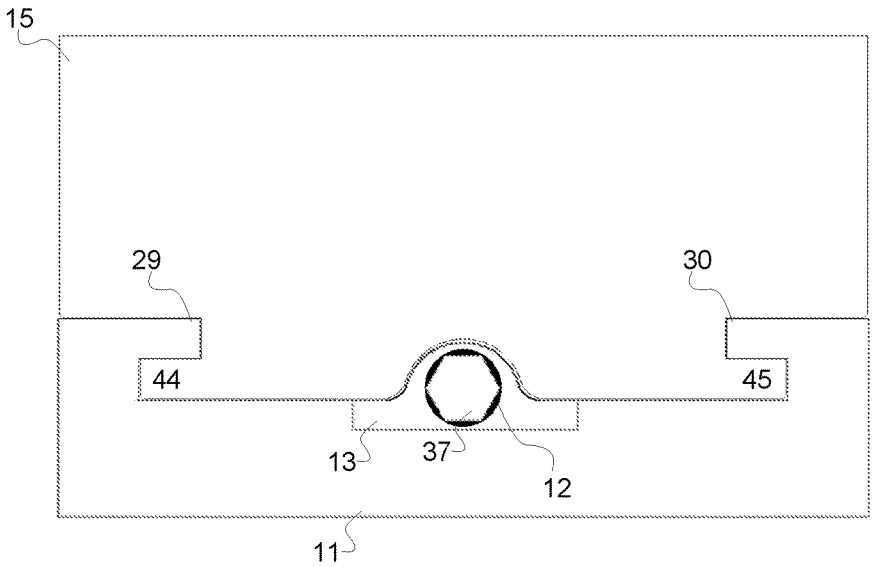
FIGS. 7*a* and 7*b* are a front view and a right side view of the pusher jaw and base plate of the vise.
Figure 7B:
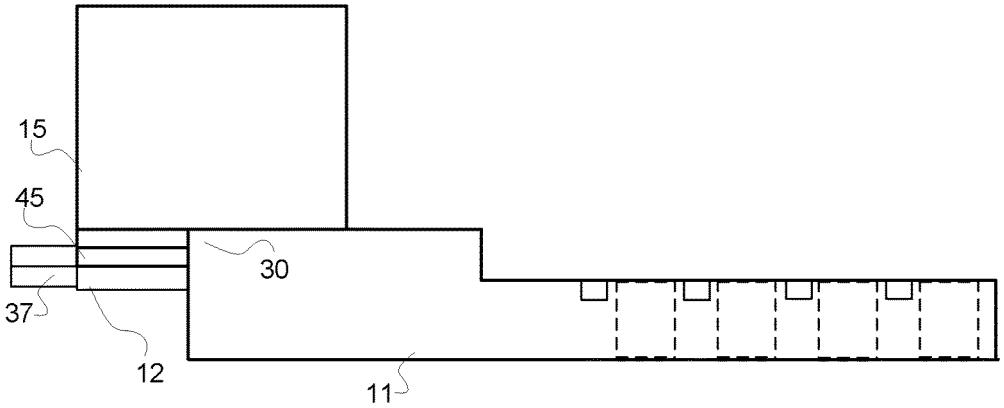

FIGS. 7*a* and 7*b* are a front view and a right side view of the pusher jaw and base plate of the vise. To couple the pusher jaw 15 with the base plate 11, the pusher jaw is inserted by an operator into the base plate with the left slide bar 44 of the pusher jaw sliding underneath the left overhang 29 of the base plate (i.e. the left slide bar being inserted into the left slide bar cavity of the base plate, the left slide bar cavity referenced as 34 in FIG. 2*b*) and the right slide bar 45 of the pusher jaw sliding underneath the right overhang 30 of the base plate (i.e. the right slide bar being inserted into the right slide bar cavity of the base plate, the right slide bar cavity referenced as 35 in FIG. 2*b*). The operator pushes the pusher jaw towards the back of the vise until it cannot be pushed any further, at which time the worm screw 12 may be rotated clockwise (when viewed from the front of the vise) through operation of the hexagonal portion 37 of the worm screw. The threaded portion of the worm screw engages the threaded worm shaft mating portion of the bottom of the pusher jaw causing the pusher jaw to move longitudinally in response to the rotation of the worm screw. The pusher jaw may be moved, through operation of the worm screw via the hexagonal portion of the worm screw, towards the fixed jaw as needed to pin a workpiece in between the pusher jaw and the fixed jaw.

In some embodiments, the fixed jaw and pusher jaw are machineable, enabling them to be fabricated into custom shapes for particular work holding and fixturing needs.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A vise, comprising:

a base plate, the base plate including at least:
- a longitudinal fixed jaw slot;
- at least one latitudinal fixed jaw slot;
- a left slide bar cavity;
- a right slide bar cavity; and
- a worm shaft;

a fixed jaw, the fixed jaw including at least:
- a longitudinal tab; and
- a latitudinal tab; and a pusher jaw, the pusher jaw including at least:
- a worm shaft mating portion;
- a left slide bar; and
- a right slide bar.

2. The vise of claim 1, wherein the base plate includes at least two counterbore through holes.

3. The vise of claim 1, wherein the base plate includes at least two table key mount holes disposed on an underside of the base plate.

4. The vise of claim 1, wherein the longitudinal fixed jaw slot is substantially perpendicular to the at least one latitudinal fixed jaw slot.

5. The vise of claim 1, wherein the base plate includes four latitudinal fixed jaw slots.

6. The vise of claim 1, wherein the base plate includes a fixed jaw mount hole arrangement.

7. The vise of claim 6, wherein the fixed jaw mount hole arrangement includes at least two mount holes.

8. The vise of claim 7, wherein the at least two mount holes are mount holes threaded to receive double-lead threaded fasteners.

9. The vise of claim 7, wherein at least two mount holes are present for each latitudinal fixed jaw slot present.

10. The vise of claim 1, wherein the fixed jaw includes at least two fixed jaw counterbore mount channels.

11. The vise of claim 1, wherein the left slide bar cavity and the right slide bar cavity are configured for permitting the left slide bar and the right slide bar of the pusher jaw to pass underneath.

12. The vise of claim 11, wherein passing the left slide bar and the right slide bar of the pusher jaw underneath the left slide bar cavity and the right slide bar cavity of the base plate interlock the pusher jaw and the base plate.

13. The vise of claim 1, wherein the worm shaft is threaded to engage a threaded section of the worm shaft mating portion of the pusher jaw.

14. The vise of claim 13, wherein operation of the worm shaft threadably engages the pusher jaw to move the pusher jaw longitudinally along the base plate.

15. The vise of claim 1, wherein at least a portion of the worm shaft is configured for receiving a hand tool.

16. The vise of claim 15, wherein a front portion of the worm shaft is hexagonal.

17. The vise of claim 1, wherein the worm shaft is coupled with the base plate using at least a front keeper and a rear keeper.

18. The vise of claim 17, wherein at least a first cylindrical portion of the worm shaft is disposed through a cylindrical channel in the front keeper, and wherein at least a second cylindrical portion of the worm shaft is disposed through a cylindrical channel in the rear keeper, a threaded portion of the worm shaft disposed between the first cylindrical portion of the worm shaft and the second cylindrical portion of the worm shaft.

19. The vise of claim 1, wherein the longitudinal fixed jaw slot of the base plate is configured for receiving the longitudinal tab of the fixed jaw.

20. The vise of claim 1, wherein the at least one latitudinal fixed jaw slot of the base plate is configured for receiving the latitudinal tab of the fixed jaw.

* * * * *